US010849407B2

(12) United States Patent
Biriukov

(10) Patent No.: US 10,849,407 B2
(45) Date of Patent: Dec. 1, 2020

(54) DEVICE FOR DISPLAYING A PERSON'S APPEARANCE

(71) Applicant: Sergei Georgievich Biriukov, Mytischi (RU)

(72) Inventor: Sergei Georgievich Biriukov, Mytischi (RU)

( * ) Notice: Subject to any disclaimer, the term of this patent is extended or adjusted under 35 U.S.C. 154(b) by 122 days.

(21) Appl. No.: 16/325,317

(22) PCT Filed: May 12, 2017

(86) PCT No.: PCT/RU2017/000307
§ 371 (c)(1),
(2) Date: Feb. 13, 2019

(87) PCT Pub. No.: WO2018/034592
PCT Pub. Date: Feb. 22, 2018

(65) Prior Publication Data

US 2019/0200730 A1 Jul. 4, 2019

(30) Foreign Application Priority Data

Aug. 19, 2016 (RU) ..... 2016133996

(51) Int. Cl.
*A45D 42/18* (2006.01)

(52) U.S. Cl.
CPC ..... *A45D 42/18* (2013.01)

(58) Field of Classification Search
CPC ..... A45D 42/18
See application file for complete search history.

(56) References Cited

U.S. PATENT DOCUMENTS 84,943 A 12/1868 Furber

FOREIGN PATENT DOCUMENTS

| | | | |
|---|---|---|---|
| CN | 201197465 | Y | 2/2009 |
| CN | 203182381 | U | 9/2013 |
| JP | H11290177 | A | 10/1999 |
| RU | 75623 | U1 | 8/2008 |
| WO | 2010016780 | A1 | 2/2010 |

OTHER PUBLICATIONS

International Search Report for the corresponding International PCT/RU20171000307; International Filing Date: May 12, 2017; dated Aug. 14, 2017; 3 pages.
Written Opinion for the corresponding International PCT/RU2017/000307; International Filing Date: May 12, 2017; dated Aug. 14, 2017; 3 pages.

*Primary Examiner* — Wen Huang
(74) *Attorney, Agent, or Firm* — Cantor Colburn LLP

(57) ABSTRACT

The present invention relates to devices for displaying a person's appearance during grooming activities, hair cutting, and shaving and is intended for use both at home and in public places. A device for displaying a person's appearance comprises mirrors, each mounted on a hinge at an end of each telescopic rod, respectively. The hinge is anchored at an end face of the mirror. There is an additional mirror introduced into the device, while first fixed sections of each telescopic rod accommodating extendable sections fitted one into the other are arranged and rigidly fixed on the additional mirror along a wall which is opposite to a reflective wall. Outlet openings of the first fixed sections are located opposite to each other. At least one of the extendable sections of each of the telescopic rod is flexible. The flexible sections are symmetric relatively to the additional mirror.

2 Claims, 4 Drawing Sheets

DEVICE FOR DISPLAYING A PERSON'S APPEARANCE

The present invention relates to devices for displaying a person's appearance during grooming activities, hair cutting, and shaving and is intended for use both at home for hair styling, curling and dyeing, doing make-up, etc., and in public places.

A displaying device consisting of two mirrors one of which is attached to the telescopic rod is known (U.S. Pat. No. 84,943 (A) 1868 Dec. 15 A45D 42/18). The known device allows a person to see the image of his/her back.

The closest prior art of the present invention is the device for displaying a person's physical appearance (WO 2010016780 (A1) 2010 Nov. 2 A45D 42/18) provided with mirrors, each mounted on an articulated joint at the end of each telescopic arm, respectively, and the articulated joint is anchored at the end face of the mirror.

The known device allows a person to see his/her back view, and at the same time it is very compact. However, in this mirror it is inconvenient to view certain side angles of oneself, it is impossible to see a front and two side (left and right) views simultaneously, and it is required to place mirrors opposite to each other, and place one of the mirrors behind a person's head (from the back).

The object of the present invention is to improve the functionality of ordinary folded mirrors, pocket mirrors (with suitable dimensions) by providing various views of a person checking his/her physical appearance.

The technical effect provided by the present invention is to display in ordinary folded (pocket) mirrors different views of a person checking his/her physical appearance via a true (unreversed) reflection while maintaining regular, natural person's movements, such as head turning or eye movement, like when using a three-leaved mirror.

Said technical effect is achieved by introducing an additional mirror into a device for displaying a person's appearance comprising mirrors, each mounted at an end of each telescopic rod by means of a hinge, respectively, and the hinge is anchored at an end face of the mirror, while first fixed sections of each telescopic rod accommodating extendable sections fitted one into the other, are arranged and rigidly fixed on the additional mirror along a wall which is opposite to a reflective wall, and outlet openings of the first fixed sections are located opposite to each other, and at least one of the extendable sections of each of the telescopic rod is flexible, wherein flexible sections are symmetric relatively to the additional mirror, while each of the hinges is made cylindrical and is provided with a torsion spring mounted on an axis, wherein one end of the torsion spring rests on the hinge and the other end rests on the mirror.

The essence of the invention will be better understood upon studying the following drawings.

Figure 1:
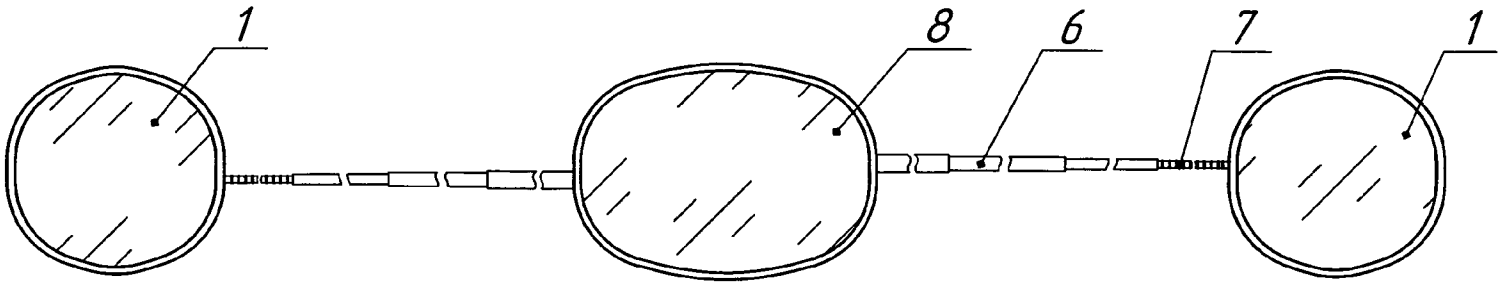
FIG. 1 is a view of a device for displaying a person's physical appearance (a front view of an unfolded pocket device).
Figure 2:
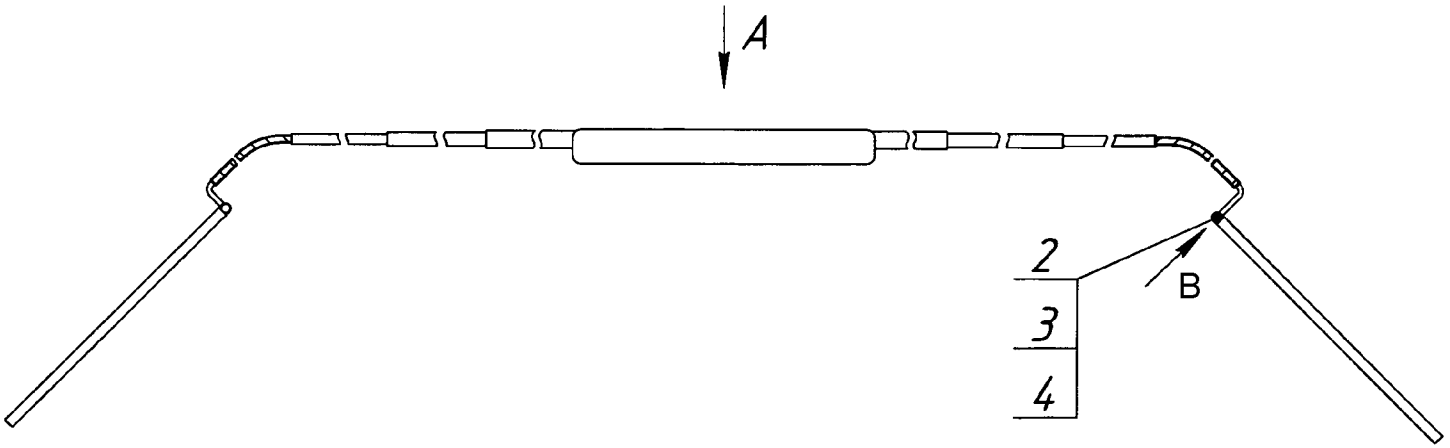
FIG. 2 is an unfolded pocket device (a top view).
Figure 3:
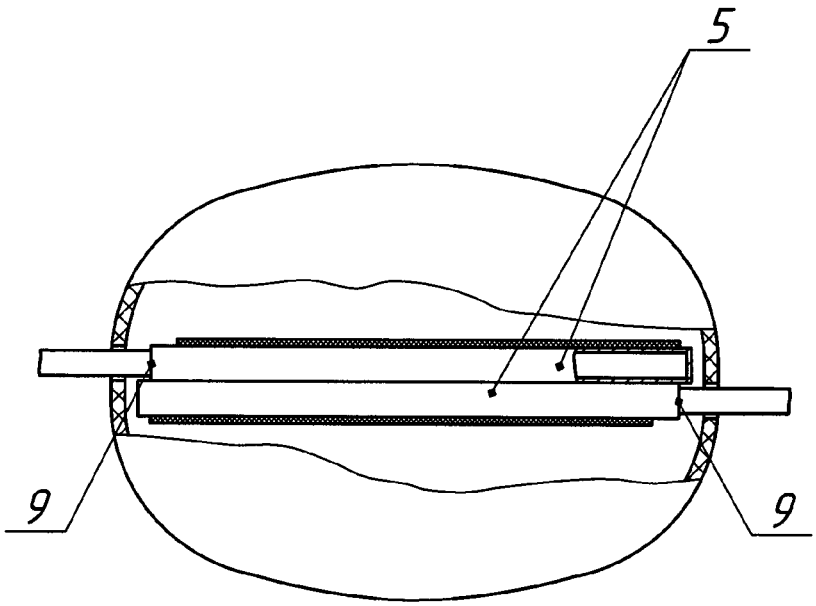
FIG. 3 is a detailed view A of FIG. 2.
Figure 4:
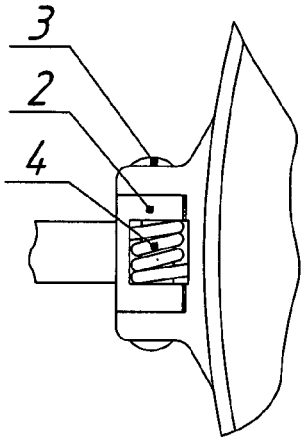
FIG. 4 is a view B of FIG. 2.
Figure 5:
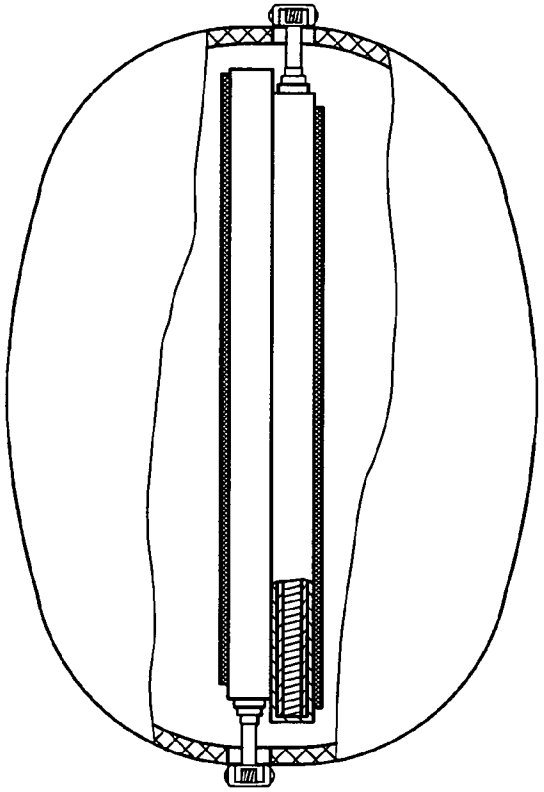
FIG. 5 is a folded pocket device (a rare view).

A device for displaying a person's appearance of the present invention is comprised of mirrors 1, each mounted by means of a hinge 2 having an axis 3 and provided with a spring 4 arranged at an end of each telescopic rod comprising a first fixed section 5 accommodating extendable sections 6 fitted one into the other, optionally, at least one section 7 of the extendable sections of an additional (central) mirror 8 is flexible, wherein the first fixed sections 5 of each telescopic rod extend, as an option, in parallel and are rigidly fixed to the additional mirror 8 along a wall which is opposite to a reflective wall, and outlet openings 9 of the first fixed sections are located opposite to each other.

Figure 6:
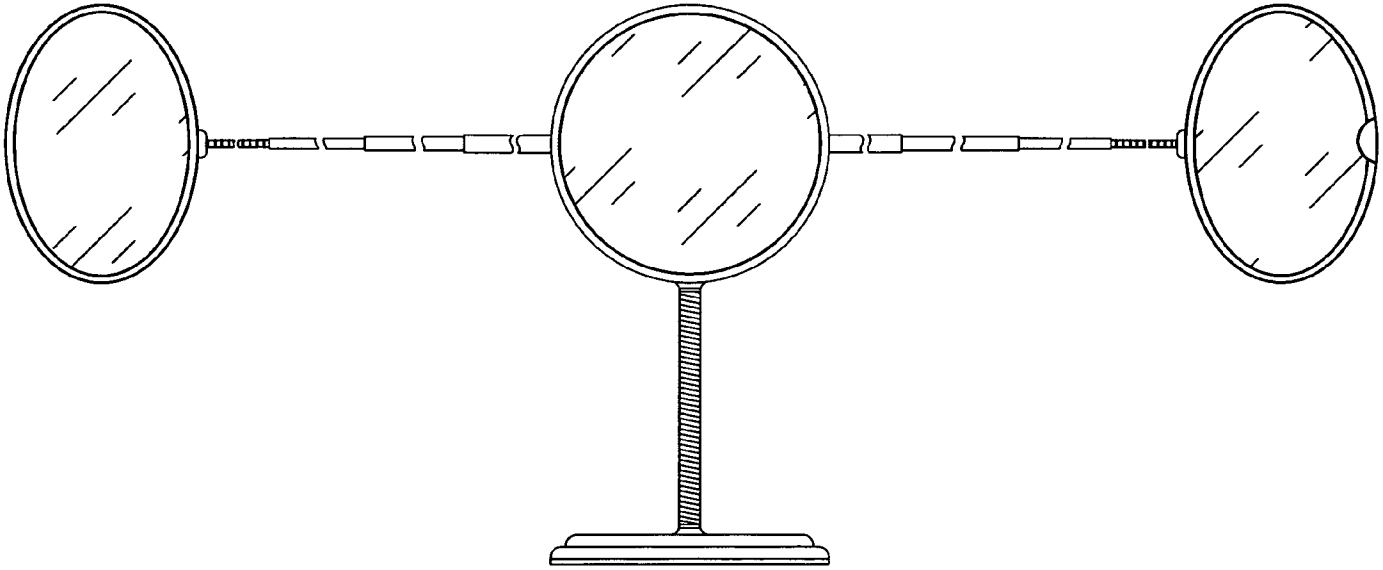
FIG. 6 is an embodiment of an unfolded tabletop device on a flexible rod (a front view).
Figure 7:
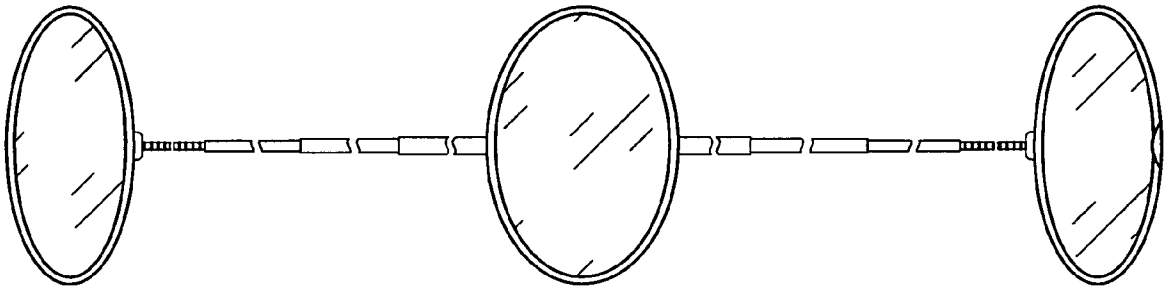
FIG. 7 is an unfolded wall device (a front view).

Possible embodiments of the structure of the device, such as a pocket one, a tabletop one (with a flexible rod, in case of structural modification), a wall-mounted one (in case of structural modification) are shown in FIGS. 1, 6, 7, respectively.

The device is operated as follows: the mirror 1 fixed, optionally by a latch, at an end face of the other mirror is opened from a folded position, preferably, from left to right, turned on the hinge 2 and, optionally, the spring 4, and moved as a result of motion of the extendable sections 6, designed to be unpivotable around the axis thereof (e.g., by shaping or forming corrugations on the walls of the sections) until all sections are extended fully or at the distance required and suitable for displaying, with the use of the flexible section 7, if required. Similarly, the other mirror is unfolded in the opposite direction and extended, as a rule, at the same distance from the central mirror. This process is carried out manually with one hand. The other hand holds the central mirror. After that, all necessary actions, such as combing, hair cutting, using a hairdryer, shaving back of the neck, etc. are possible. The mirrors do not impede the use of appliances because the mirrors are at a significant distance from a user's head. After the use, the device can be folded in the reversed order.

The present invention can be used both at home, for example in an entrance hall, where the space is limited (a tabletop and wall-mounted option) and in any other situations when a user, for instance, wants to immediately check and tidy his/her hair (a pocket device). In any circumstances, a device with the possibilities of a three-leaved mirror will always be at a user's disposal.

The invention claimed is:

1. A device for displaying a person's appearance comprising mirrors, each mounted by means of a hinge at an end of a telescopic rod, respectively, and the hinge is fixed on an end face of the mirror, characterized in that an additional mirror is introduced into it, while first fixed sections of each telescopic rod accommodating extendable sections fitted one into the other are arranged and rigidly fixed on the additional mirror along a wall which is opposite to a reflective wall, and outlet openings of the first fixed sections are arranged opposite to each other, while at least one of the extendable sections of each telescopic rod is flexible, wherein the flexible sections are arranged symmetrically relative to the additional mirror.

2. The device for displaying a person's appearance according to claim 1, characterized in that each hinge is made cylindrical and provided with a torsion spring mounted on an axis, with one end of the torsion spring resting on the hinge and the other end resting on the mirror.

* * * * *